US006676530B2

(12) United States Patent
Lochtefeld

(10) Patent No.: US 6,676,530 B2
(45) Date of Patent: Jan. 13, 2004

(54) CONTOURED VARIABLY TENSIONABLE SOFT MEMBRANE RIDE SURFACE FOR RIDE ATTRACTION

(75) Inventor: Thomas J. Lochtefeld, La Jolla, CA (US)

(73) Assignee: Light Wave, Ltd., La Jolla, CA (US)

( * ) Notice: Subject to any disclaimer, the term of this patent is extended or adjusted under 35 U.S.C. 154(b) by 0 days.

(21) Appl. No.: 10/124,771

(22) Filed: Apr. 17, 2002

(65) Prior Publication Data

US 2003/0004003 A1 Jan. 2, 2003

Related U.S. Application Data

(60) Provisional application No. 60/284,699, filed on Apr. 17, 2001.

(51) Int. Cl.[7] ..... A63G 21/18

(52) U.S. Cl. ..... 472/117; 472/128; 472/90

(58) Field of Search ..... 472/88, 89, 90, 472/91, 117, 128, 129; 428/92, 93, 99, 15, 85, 96, 97

(56) References Cited

U.S. PATENT DOCUMENTS

| | | | | | |
|---|---|---|---|---|---|
| 2,558,759 | A | * | 7/1951 | Johnson | 472/90 |
| 3,120,385 | A | * | 2/1964 | Hall | 472/91 |
| 3,547,749 | A | * | 12/1970 | White et al. | 428/89 |
| 4,087,088 | A | * | 5/1978 | Kelso | 472/91 |
| 4,147,844 | A | | 4/1979 | Babinsky et al. | |
| 4,339,122 | A | * | 7/1982 | Croul | 472/88 |
| 4,988,364 | A | | 1/1991 | Perusich et al. | |
| 5,219,315 | A | * | 6/1993 | Fuller et al. | 472/59 |
| 5,384,019 | A | * | 1/1995 | Keating et al. | 204/252 |
| 5,447,636 | A | * | 9/1995 | Banerjee | 210/638 |
| 5,738,590 | A | | 4/1998 | Lochtefeld | |
| 5,827,608 | A | | 10/1998 | Rinehart et al. | |

* cited by examiner

*Primary Examiner*—Kien T. Nguyen
(74) *Attorney, Agent, or Firm*—Jonathan A. Barney

(57) ABSTRACT

A ride surface for water ride attractions and the like is provided. The ride surface is fabricated from a reinforced membrane material tensioned over a supporting framework. The tensioned membrane ride surface serves the dual role of providing structural support for water flow and riders thereon while at the same time providing an impact safe surface that is non-injurious to riders who may fall thereon. The tensioned membrane can be adjusted actively and/or passively in order to accommodate different and varied ride experiences. Optionally, the shape of the membrane ride surface can be changed either dynamically or passively by special tensioning techniques and/or by using auxiliary support structures such as air bladders, pressure/suction, foam supports or/or the like.

81 Claims, 6 Drawing Sheets

CONTOURED VARIABLY TENSIONABLE SOFT MEMBRANE RIDE SURFACE FOR RIDE ATTRACTION

RELATED APPLICATIONS

This application claims priority under 35 U.S.C. § 119(e) to provisional application U.S. Serial No. 60/284,699 filed Apr. 17, 2001.

BACKGROUND OF THE INVENTION

1. Field of the Invention

This invention relates in general to improved ride surfaces for sliding-type ride attractions, water rides and the like and, in particular, to a variably tensionable membrane ride surface for a simulated surfing wave ride attraction.

2. Description of the Related Art

Water parks and water ride attractions have increased in popularity over the years as an enjoyable family diversion during the hot summer months. Each year water parks invest hundreds of thousands of dollars for ever larger and more exciting water ride attractions to attract increasing numbers of park patrons.

One particularly exciting attraction is the simulated surfing wave water ride attraction known commercially as Flow Rider®. In this attraction, riders ride upon an injected flow of high-speed sheet water flow that is continuously propelled up an inclined ride surface. The thickness and velocity of the injected sheet flow relative to the angle of the inclined ride surface is such that it creates simultaneously a hydroplaning or sliding effect between the ride surface and the rider and/or ride vehicle and also a drag or pulling effect upon a rider and/or ride vehicle hydroplaning upon the sheet flow. By balancing the upward-acting drag forces and the downward-acting gravitational forces, skilled riders are able to maneuver a surfboard (or "flow board") upon the injected sheet water flow and perform surfing-like water skimming maneuvers thereon for extended periods of time thereby achieving a simulated and/or enhanced surfing wave experience.

For example, my U.S. Pat. No. 5,236,280, incorporated herein by reference in its entirety, first disclosed the concept of an artificial simulated wave water ride attraction of this type having an inclined ride surface covered with an injected sheet flow of water upon which riders could perform water skimming maneuvers simulative of actual ocean surfing. Sheet flow water rides are currently in widespread use at many water parks and other locations around the world. Such rides allow the creation of an ideal live-action surfing wave experience even in areas that do not have access to beaches or an ocean.

These and other similar attractions have enjoyed immense popularity among park-going patrons. Owners and operators of park facilities that have installed such attractions have enjoyed significant improvements in park patronage due to the simulated wave water ride attractions and the particularly desirable patrons they attract. In fact, some park owners have demanded more challenging and larger, more powerful wave ride attractions in a bid to attract the most skilled and masterful riders to their parks and to accommodate large-scale professional competitions and the like.

However, current manufacturing techniques are limited in the ability to inexpensively produce large-scale surfing wave ride attractions and the like (e.g. slides, flumes, water coasters, bowls, half-pipes, etc.). According to the current state of the art, ride surfaces for such attractions are generally fabricated from concrete and/or one or more pre-molded fiberglass sections which are sanded smooth and then bolted or otherwise assembled together to form a single, generally continuous ride surface. The ride surface is typically assembled on site and secured to a suitable supporting framework. For ride surfaces susceptible to impacts from riders, a lubricious and/or soft coated foam material is typically adhered or bonded to the exposed "hard" upper concrete or fiberglass support surface to provide a composite ride surface that is both strong enough to support one or more riders, while providing a "soft" non-injurious surface to riders who may fall thereon.

Such composite foam/fiberglass/concrete ride surfaces are expensive and time-consuming to produce. They also suffer from certain physical and other limitations which have made these and other similar composite ride surfaces cost-prohibitive for larger-width ride attractions. The physical demands placed on the ride surface dramatically increase with width, sometimes requiring additional engineering and structural reinforcement to ensure adequate safety and durability. Also, due to size limitations of standard commercial shipping containers, it is often commercially infeasible to prefabricate a large, contoured ride surface as a single integral structure. Presently, most large ride surfaces are poured in concrete on-site and sculpted by hand using highly skilled laborers. But this is an expensive and time-consuming process and depends upon the availability of a suitably skilled local labor force. An alternative approach includes assembling a large number of smaller fiberglass components or sections and securing them to an underlying supporting framework on site. However, this manufacturing and assembly technique produces undesirable seams which can have an adverse affect on the compliance and support characteristics of the underlying ride surface. Because these seams create discontinuities in an otherwise continuous, ride surface, certain latent or imposed stresses, such as thermal expansion and contraction, can have a tendency to focus or concentrate strain energy at the seams, leading to possible buckling and/or cracking of the ride surface at or around the seams. This, in turn, can create undesirable warpage and/or rippling of the ride surface, which can adversely affect ride performance and increase maintenance costs.

In addition, the coated foam material is typically available commercially in only limited widths. Thus, for wider ride surfaces multiple swaths of such foam material must be adhered or bonded to the underlying support surface in a side-by-side fashion with closely abutting edges. But perfectly contiguous alignment and abutment is a difficult condition to achieve and, in any event, the technique creates undesirable seams which are susceptible to ripping, tearing or peeling in addition to some or all of the other deleterious effects described above. The seams in the foam covering and/or the foam covering itself can often leak and thereby admit water in between the foam material and the underlying fiberglass ride surface and/or in between the foam material and the lubricious surface coating thereon. This can cause the formation of undesirable "blisters" which, again, can adversely affect ride performance. If not immediately arrested, the blisters can quickly degenerate into a major ride surface delamination problem, possibly requiring complete resurfacing of the ride surface. Again, this increases the expense of maintaining a ride attraction having such composite foam/fiberglass/concrete ride surface or other "hard" support surface. These and other manufacturing and structural hurdles have made the large ride attractions quite expensive to construct and maintain.

Current state-of-the-art composite fiberglass and concrete ride surfaces—due to their rigid and static nature—also fail to filly simulate the kinematic motion and reactive hydraulic forces or "bounce" associated with true deep-water ocean surfing. A stiff, unyielding ride surface can thus impair or hinder ride performance and maneuverability of amateur riders, particularly in flat or gently curved sections of the ride.

Accordingly, there is a need for an alternative ride surface and method of fabrication thereof which does not suffer from all or some of the aforenoted drawbacks.

SUMMARY OF THE INVENTION

A ride surface constructed in accordance with the present invention overcomes some or all of the aforenoted drawbacks and disadvantages. In one preferred embodiment the invention provides a membrane ride surface fabricated from a relatively inexpensive fabric, plastic film or composite material that is placed under tension over a supporting framework. Advantageously, the tensioned membrane ride surface in accordance with the invention serves the dual purpose of providing structural support for water flow and riders thereon while at the same time providing an impact safe surface that is non-injurious to riders who may fall thereon. Because the membrane material serves both support and impact functions, there is no need to adhere an additional foam layer material thereon to provide protection from rider impacts. This results in a less-expensive, more durable and long-lasting ride surface that is not afflicted by the aforementioned blistering and delamination problems. Moreover, because the membrane is stretched and tensioned to form a supporting ride surface, it is capable of absorbing significantly more energy during rider impact, as compared to a layer of soft foam material adhered to a relatively hard fiberglass support surface. Thus it is safer for riders and facilitates more extreme and exciting maneuvering, such as flips, spins, twists, lip bashes, and cartwheels, with a greater degree of safety. Advantageously, the membrane is also capable of supporting varying tensions and so the compliance or "trampoline effect" of the ride surface can be adjusted to provide a desired level of bounce and reactive forces to accommodate varying rider skill levels and/or to provide a more "deep water" surfing feel by more closely simulating the hydraulic forces associated with deep-water surfing on a propagating ocean wave.

Suitable membrane materials can be purchased and/or glued/hemmed/welded together to form any desired width of contiguous material. Thus a single integral ride surfacing material may be provided that can easily be packaged and shipped using standard shipping containers and the like. The ride surface and the underlying supporting frame can easily be assembled and adjusted on site with standard assembly tooling (e.g., a ratchet, wrench, and tensioning bar). Thus, on-site labor and material costs are significantly reduced.

The membrane ride surface is preferably formed from a substantially contiguous sheet of fabric/plastic and/or other strong, pliable sheet material. The membrane is tensioned at its edges to provide the desired rigidity to support a sheet water flow and riders thereon while at the same time providing sufficient compliance to provide energy absorption in the event of a fallen rider impacting the ride surface. Advantageously, the tensioned membrane design provides inherent flexibility in that the tension of the membrane can be adjusted actively and/or passively in order to accommodate different and varied ride experiences. Also, the shape of the membrane ride surface (and, thus, the size, shape and nature of the sheet water flow and simulated wave forms thereon) can be changed either actively or passively by special tensioning techniques and/or by using air bladders, pressure/suction, foam supports or/or the like. Thus, the invention provides heretofore unknown flexibility and wave riding challenge.

In one embodiment the invention provides a ride attraction comprising an inclined ride surface adapted to safely support one or more ride participants and/or ride vehicles sliding thereon. The inclined ride surface comprises a substantially continuous sheet of membrane material supported along at least two edges thereof by a supporting framework. The membrane material has a coating thereon, such as a fluorinated polymer, adapted to provide a substantially smooth and generally lubricous sliding surface. The membrane material is tensioned so as to provide a resilient, impact-safe support surface for ride participants and/or ride vehicles sliding thereon. One or more nozzles may be further provided for injecting a sheet flow of water upon the ride surface and thereby simulating an ocean surfing experience. Auxiliary support structures may be added for additional support of the ride surface and/or to create various desired dynamic ride effects.

In another embodiment the invention provides a ride surface for ride attractions and the like. The ride surface comprises a fabric-reinforced membrane material supported by a structural framework tensioning the fabric-reinforced material to at least about 10 $Kg_f$/cm. The membrane material is coated with a friction-reducing material adapted to facilitate sliding thereon by ride patrons. If desired, one or more nozzles may be provided for injecting a sheet flow of water upon the ride surface and thereby simulating an ocean surfing experience. Auxiliary support structures may also be added for additional support of the ride surface and/or to create various desired dynamic ride effects.

In another embodiment the invention provides a kit for assembling a ride attraction. The kit comprises a fabric-reinforced ride surface sized and adapted to safely support one or more ride participants and/or ride vehicles thereon. A supporting framework is also provided and is adapted to support and apply tension to the membrane ride surface. Tensioning means are provided for adjusting the amount of tension applied by the framework to the ride surface whereby a resilient supporting surface is provided for safely supporting one or more riders. Again, one or more nozzles may be further provided, if desired, for injecting a sheet flow of water upon the ride surface and thereby simulating an ocean surfing experience. Auxiliary support structures may also be added for additional support of the ride surface and/or to create various desired dynamic ride effects.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF DRAWINGS

Having thus summarized the general nature of the invention and its essential features and advantages, certain preferred embodiments and modifications thereof will become apparent to those skilled in the art from the detailed description herein having reference to the figures that follow, of which.

DETAILED DESCRIPTION OF THE PREFERRED EMBODIMENTS

Figure 1:
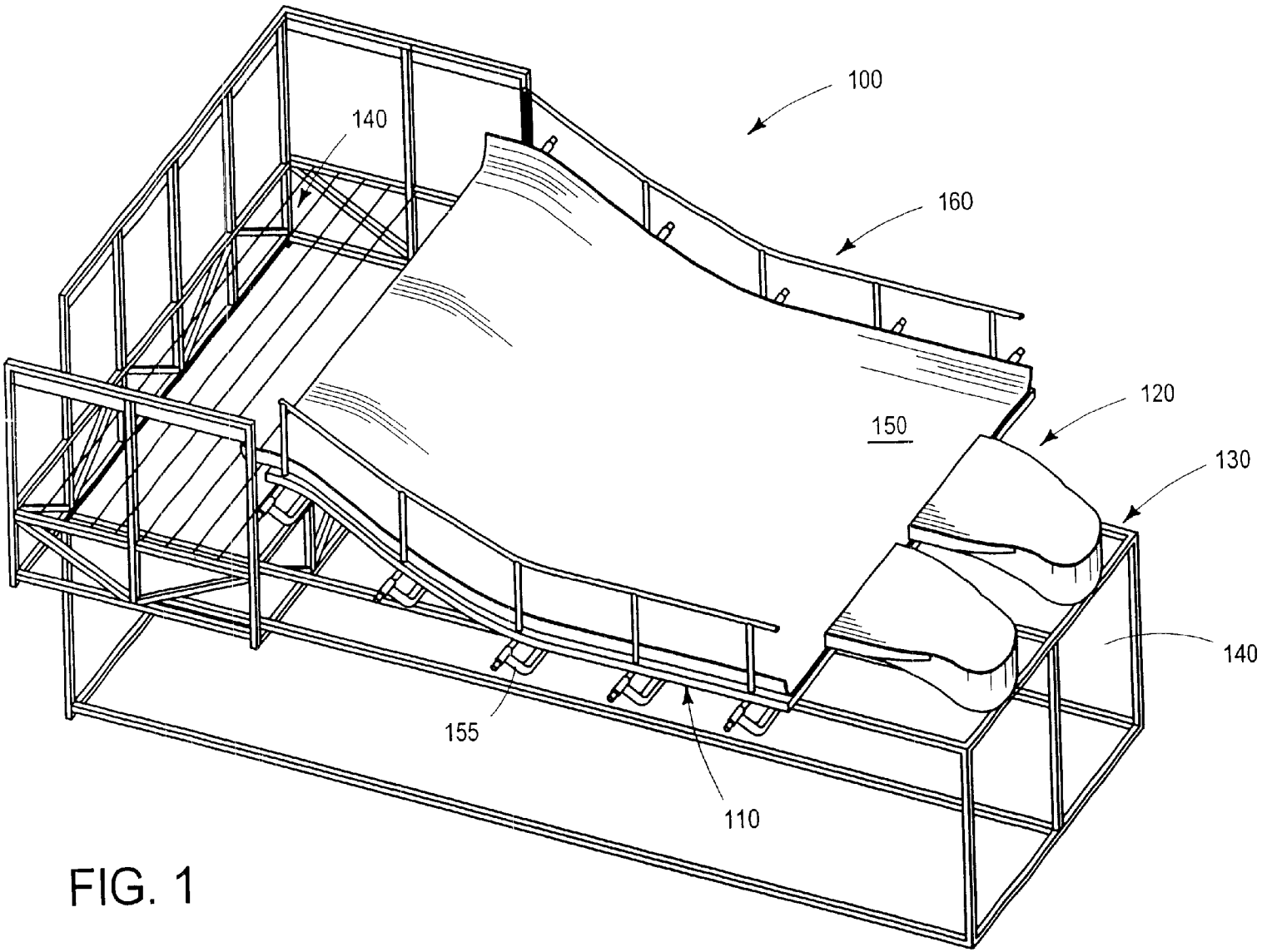
FIG. 1 is an isometric view of a simulated surfing wave ride attraction having a tensioned fabric/membrane ride surface in accordance with one preferred embodiment of the invention.

FIG. 1 is an isometric view of a simulated surfing wave ride attraction 100 incorporating a tensioned membrane ride surface 150 in accordance with one preferred embodiment of the present invention. FIG. 2 is a partial schematic, longitudinal cross-section view of the ride attraction of FIG. 1 while in operation, illustrating in more detail the hydraulic and operational characteristics and components thereof.

Figure 2A:
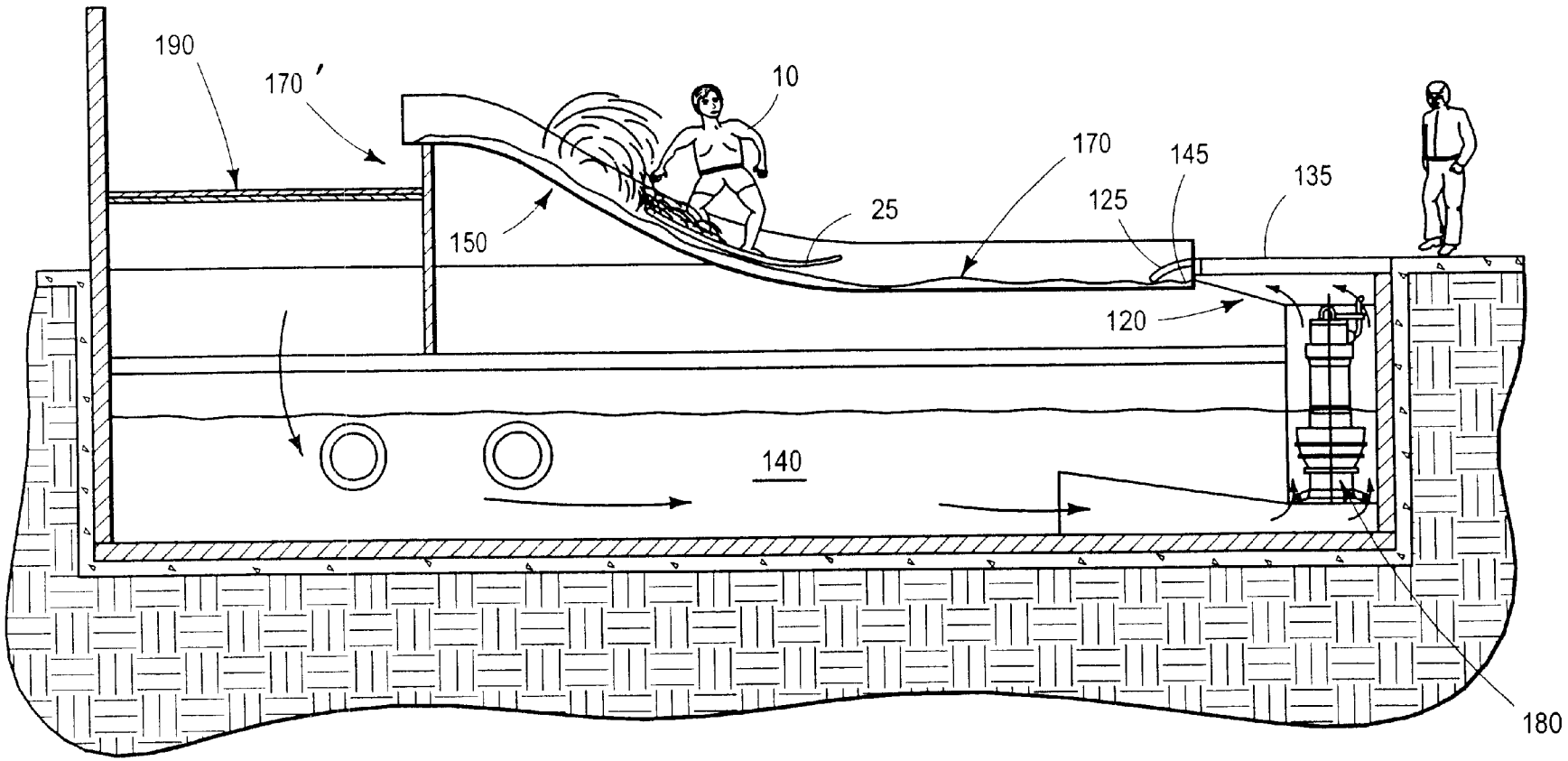
FIG. 2A is a partially schematic longitudinal cross-section view of the ride attraction of FIG. 1, illustrating the operation thereof.
Figure 2B:
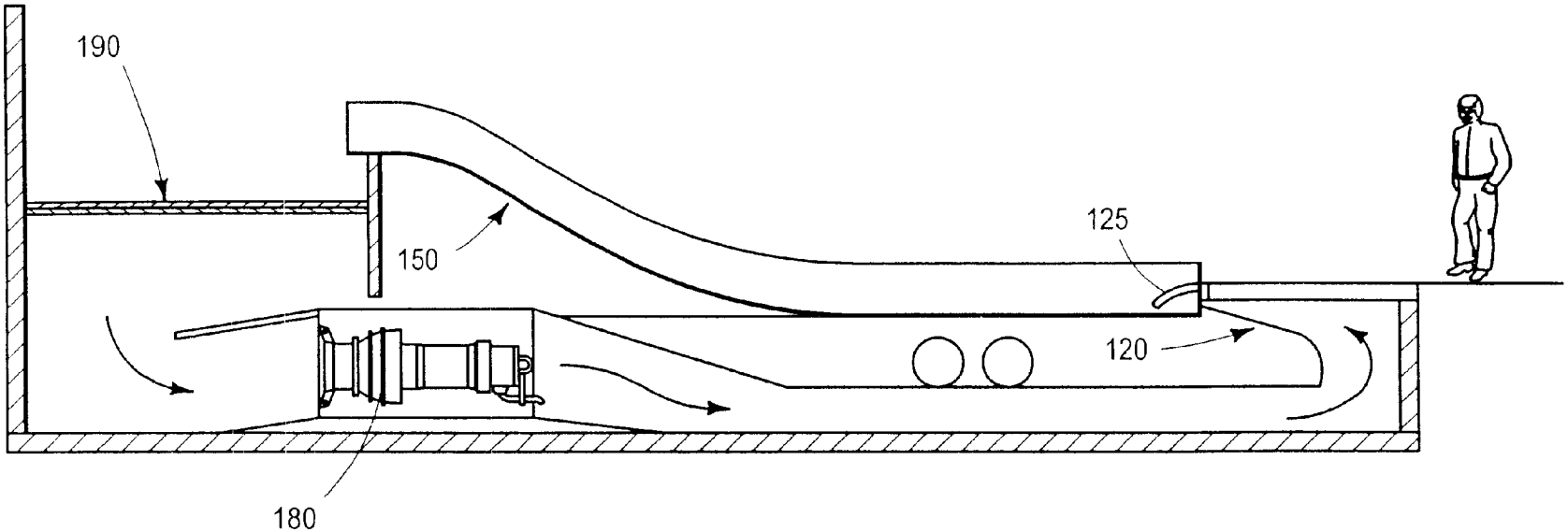
FIG. 2B is a partially schematic longitudinal cross-section view of a possible alternative configuration of the ride attraction of FIGS. 1 and 2A

As illustrated in FIGS. 1 and 2, the ride attraction 100 generally comprises an inclined fabric/membrane ride surface 150 (measuring approximately 7.0 m long×5.0 m wide) tensioned over a supporting framework 110, as illustrated. Framework 110 comprises multiple tensioning spars 155, as illustrated. If desired, the framework 110 may be supported by an optional sub-support system 130, which may further include a sub-support foundation (not shown), one or more water reservoirs 140, and/or safety railings/sidewalls 160. As illustrated, in FIG. 2A the lower portion of the inclined ride surface 150 is positioned relative to one or more water injection nozzles 120 so as to receive a high speed sheet flow of water 170 thereon. The nozzles 120 are preferably made of either steel, fiberglass, reinforced concrete or other structurally sound material that can withstand water pressures of 8 to 45 psi (0.5 to 3 bar). The vertical opening or sluice gate 145 of each nozzle is preferably about 4 to 30 cm with a preferred opening of about 7.5 cm. The beak like shape of the nozzle 120 provides a compact form and thus advantageously minimizes the overall height of the fixed decking 135 above the emitted sheet flow 170.

In operation (see, e.g., FIG. 2A), water is injected onto the ride surface 150 by one or more high-pressure pumps 180 placed in hydraulic communication with one or more of the water injection nozzles 120. The pumps 180 provide the primary driving mechanism and generates the necessary head or water pressure needed to deliver the required quantity and velocity of water from the flow forming nozzles 120. A portion of the water flow 170, if lacking sufficient kinetic energy to flow over the ridgeline 155, rolls down and off to the side of the ride surface 150 along either side of the emitted flow 170, draining though side exit grates 195 adjacent nozzles 120 (see FIGS. 1 and 2A). Side grates 195 are preferably made from extruded fiberglass covered with a soft vinyl tube matting. The majority of emitted sheet water flow 170' flows over the top of the ride surface 110 and drains through a porous recovery floor 190, as illustrated in FIG. 2A. The recovery floor 190 is preferably configured to support "wiped-out" riders 10 and enable them to stand up and exit the ride attraction 100 while simultaneously allowing water to drain back into reservoir 140. Preferably, the porous recovery floor 190 comprises an extruded fiberglass grate covered with a soft vinyl tube matting or perforated rubberized matting.

Two preferred alternative hydraulic/pump configurations are illustrated in FIGS. 2A (vertical pumps) and 2B (horizontal pumps). Horizontal pump placement is generally preferred for minimizing excavation and subterranean depth, while vertical placement is preferred for ease of ease of pump maintenance and replacement. Of course, the pumps could also be angled or otherwise configured or arranged in any manner desirable or necessary to provide optimal performance and operational efficiency. Other than as specifically described herein, the particular pump/hydraulic systems layout and operations of the ride attraction 100 are relatively unimportant for purposes of understanding and practicing the present invention. Nevertheless, if desired, a more complete understanding thereof may be had by reference to my U.S. Pat. No. 6,132,317, which is incorporated herein by reference as if fully reproduced herein.

The thickness and velocity of the injected sheet flow 170 relative to the angle of the inclined ride surface 150 is preferably such that it creates simultaneously a hydroplaning or sliding effect between the ride surface and a rider/vehicle 10 thereon and also an upward directed drag or pulling effect upon the rider/vehicle 10 hydroplaning upon the sheet flow 170. By balancing the upward-acting drag forces and the downward-acting gravitational forces, a skilled rider 10 is able to maneuver a specially modified surfboard 25 ("flow board") or body board upon the injected sheet water flow 170 and generally perform surfing-like water skimming maneuvers thereon for extended periods of time, thereby achieving a simulated and/or enhanced surfing wave experience.

In particular, as illustrated in FIG. 2A a rider 10 is able to ride and perform surfing/skimming maneuvers upon the upward flowing sheet water flow 170 and to thereby control his speed and position upon the ride surface 150 through a balance of forces, e.g., gravity, drag, hydrodynamic lift, buoyancy, and self-induced kinetic motion. For example, the rider 10 can maximizing the hydroplaning characteristics of his or her ride vehicle 25 by sliding down the inclined ride surface 150 and over the upcoming flow 170 while removing drag inducing surfaces such as hands and feet from the water flow. On the other hand, the rider 10 can reverse this process and move back up the incline with the water flow 170 by positioning or angling his vehicle 25 to reduce planing ability and/or by inserting hands and feet into the water flow to increase drag. A variety of surfing-like maneuvers such as turns, cuts, cross-slope runs, lip-bashing, oscillating and many others are facilitated. Because the membrane ride surface 150 is flexible and, therefore, movable under the weight of the rider 10, the rider 10 is able to balance and react to varying pressures exerted on, and counter-pressures exerted by, the ride surface 150. This trampoline-like compliance also makes the ride safer for riders and, thus, facilitates more extreme and more exciting "trick" maneuvers, such as flips, spins, twists, lip bashes, and cartwheels, with a greater degree of safety. Advantageously, the membrane can be adjusted to provide a desired level of bounce and reactive forces to accommodate varying rider skill levels and/or to provide a more "deep water" surfing feel by more closely simulating the hydraulic forces associated with deepwater surfing on a propagating ocean wave, thereby adding to the overall ride experience and challenge of the ride.

As illustrated in FIG. 2, if desired a soft foam sluice cover 125 may be provided adjacent the lower end of the ride surface 150 over the exit or sluice portion of the nozzle 120 to provide an energy-absorbing and/or slide-over safety structure that protects riders 10 from possibly colliding with the nozzle 120 and/or interfering with ride operation. The sluice cover 125 preferably forms a flexible tongue which is urged downward upon the water flow 170 to seal the nozzle area off from possible injurious contact from a rider 10. The sluice cover 125 also advantageously provides a short transition surface over the top of which a rider 10 can safely slide and exit the ride.

The sluice cover 125 preferably comprises a contoured flexible pad which covers and extends over the top surface of the nozzle 120. The pad is preferably spring-loaded in a downward direction to keep spring tension against the jetted water flow 170 and thus minimize the possibility of a rider 10 catching a finger underneath the pad when sliding up and over the pad. The pad ranges from 1/16th inch thick at it furthest downstream point to approximately 1 inch thick where it abuts to a fixed decking 135. The pad is preferably made out of any suitable soft flexible material that will avoid injury upon impact, yet rigid enough to hold its shape under prolonged use. Suitable pad materials include a 2 lb (0.9 kg) density closed cell polyurethane foam core that is coated with a tough but resilient rubber or plastic, e.g., polyurethane paint or vinyl laminate. See, for example, my published PCT application PCT/US00/21196 designated as publication number WO01/08770, hereby incorporated by reference herein in its entirety. Alternatively, the sluice slide over cover 125 may comprise a flexible pad to which is bonded or upholstered a membrane material similar to that described herein-above for ride surface 150. Of course, a variety of other suitable designs and materials may also be used as will be readily apparent to those skilled in the art.

As indicated above, the ride surface 150 is preferably fabricated from a suitably strong fabric/membrane material 300 that is suitably tensioned over an underlying supporting framework 110. The membrane is preferably tensioned at its edges to provide the desired rigidity to support a sheet water flow and riders thereon. Advantageously, the tensioned membrane design provides inherent versatility in that the tension of the membrane can be adjusted actively and/or passively in order to accommodate different and varied ride experiences. Also, the shape of the membrane ride surface can be changed either actively or passively by special tensioning techniques and/or by using air bladders, suction, foam supports or/or the like.

Figure 3:
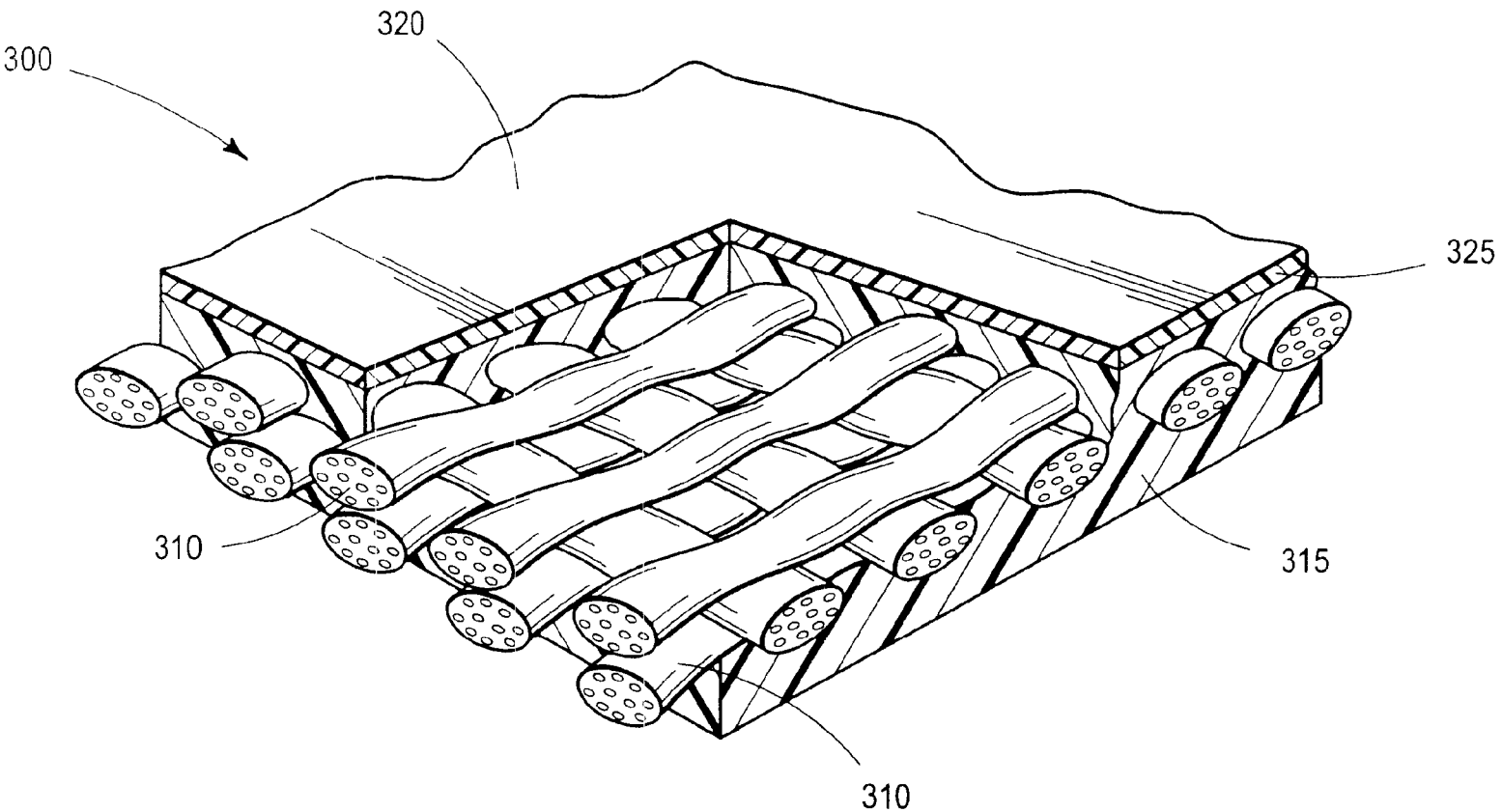
FIG. 3 is a partial cut-away detail view of a reinforced fabric/membrane ride surface having features in accordance with the present invention.

Examples of suitable fabric/membrane materials include a wide variety of sheet or fabric materials formed from fibers or yarns comprising one or more of the following: carbon fiber, Kevlar®, rayon, nylon, polyester, PVC, PVDF and/or similarly strong, durable fibrous materials. See, e.g. U.S. Pat. No. 4,574,107 to Ferrari, incorporated herein by reference. As illustrated in more detail in FIG. 3, the yarns 310 comprising fabric/membrane 300 may be woven, knitted, extruded or otherwise formed or intertwined in any number of suitable weaves or patterns as manufacturing expedients dictate. Preferably, the fabric/membrane material 300 includes a smooth flexible coating 315 on one or both sides in order to provide a lubricious, generally water-tight ride surface 320. Suitable coating materials 315 may include, for example and without limitation, rubber, polyurethane, latex, Teflon, fluorinated polymers, PVDF and/or the like. Preferably, such coated fabric material is substantially smooth and free of sharp or abrasive edges.

One particularly preferred type of membrane material 300 comprises high-strength polyester 1670/2200 Dtex PES HT yarns woven to form a high-strength fabric base cloth. The base cloth is preferably tensioned substantially equally in weft and warp while a polymer coating approximately 200–300 $\mu$m thick is applied to the top and bottom surfaces thereof. The upper surface 320 (the ride surface) is additionally coated with a fluorinated polymer material 325, such as PVDF, approximately 10–50 $\mu$m thick, providing a durable, lubricious sliding surface. Preferably, the finished fabric/membrane material has an overall thickness of between about 0.5 and 2.0 mm (1.2 mm being most preferred) and a weight less than about 5.0 kg/m$^2$, more preferably less than about 2.0 kg/m$^2$, and most preferably about 1.5 kg/m$^2$. Suitable fabric/membrane materials are preferably selected to have a tensile strength greater than about 20 $kg_f$/cm, more preferably greater than about 50 $kg_f$/cm, and most preferably greater than about 80 $kg_f$cm as determined by NF EN ISO 1421 FTMS 191A (Method 5102), and a tear strength preferably greater than about 50 $kg_f$, more preferably greater than about 75 $kg_f$, and most preferably greater than about 90 $kg_f$, as determined by DIN 53.363 ASTM D 5733–95 (Trapezoid Method), and with a maximum elongation under design load of preferably less than about 1% in either weft or warp.

Suitable materials meeting the above preferred specifications are readily available commercially in relatively wide swaths. If desired, multiple swaths of fabric/membrane material can also be hemmed, glued or, more preferably, welded together to form very wide continuous swaths of continuous material to meet virtually any ride surfacing need. Thus a single integral ride surfacing material is provided that can easily be packaged and shipped using standard containers and the like.

Advantageously, the tensioned membrane ride surface 150 in accordance with the invention serves the dual purpose of providing adequate support for water flow and riders thereon while at the same time providing an impact-safe surface that is non-injurious to riders who may fall thereon. Because the membrane material serves both functions, there is no need to adhere an additional foam layer material thereon to provide protection from rider impacts. As noted above, this results in significant cost savings and also avoids the afore-mentioned blistering and delamination problems. Thus a safer, more durable and inexpensive ride surface is provided. Moreover, the ride surface 150 and the underlying supporting frame 110 can easily be assembled and adjusted on site using standard hand-tools, reducing on-site labor and material costs.

Figure 4A:
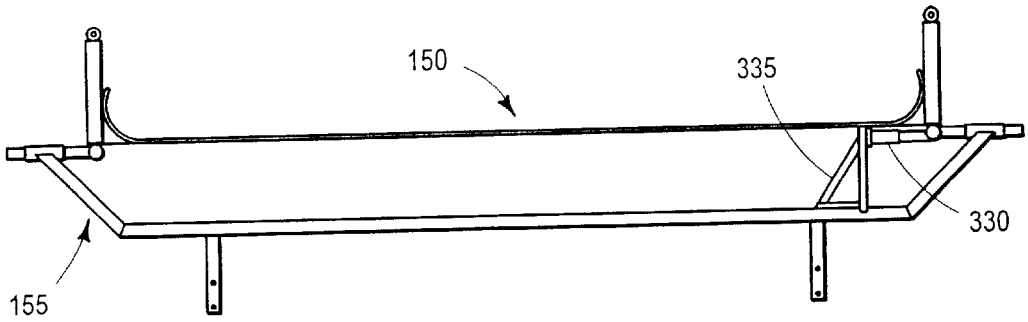
FIG. 4A is a front elevation detail view of a tensioning spar having features and advantages of the present invention.
Figure 4B:
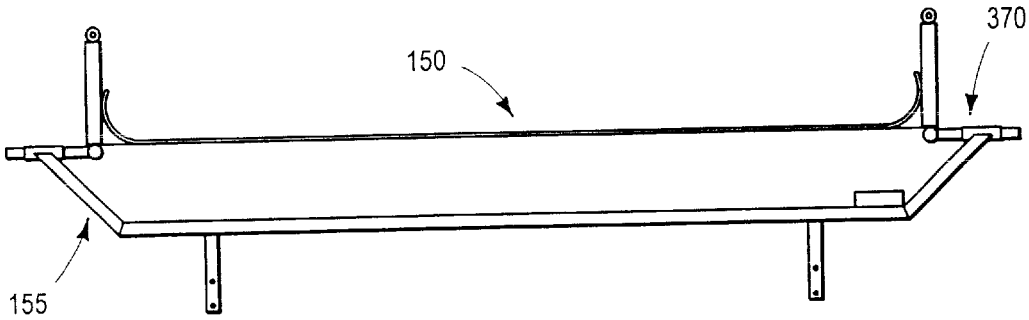
FIG. 4B is a front elevation detail view of a tensioning spar and installed jack frame having features and advantages of the present invention.

Preferably, the membrane material 150 is maintained in tension via multiple tensioning spars 155 distributed along the length of the ride surface 150. As illustrated in more detail in FIGS. 4A and 4B, each tensioning spar 155 is preferably shaped and configured to adequately support the membrane ride surface 150 at the edges thereof, while simultaneously applying a desired tension thereto in at least one direction across the membrane. Tensioning may be desirably accomplished using any number of suitable devices and/or techniques. One preferred technique is to use a hydraulic tensioning jack 330 and jacking frame 335. The jacking frame 335 bears against the frame 110 and/or spar 155 to pull or tension the membrane ride surface 150 across the tensioning spar. Once the tension is set by the tensioning jack, the membrane material 150 may be secured to the frame 150 using an adjustment collar 370 comprising one or more pins inserted through a series of spaced adjustment holes 375 (see, e.g., FIG. 5B) and/or using any number of other suitable fasteners, as desired. Alternatively, the hydraulic jack may be actively and/or remotely controlled to provide dynamic tensioning of the ride surface 150. Alternatively, one or more screw tensioners may be provided for purposes of providing simple tension adjustments as will be well understood by those skilled in the art.

Preferably, the amount and direction(s) of tension applied to the membrane is such that the membrane material 300 forms a resilient supporting surface 150 capable of supporting a sheet flow of water thereon and one or more riders, while providing a compliant, energy-absorbing surface capable of safely absorbing the impact of possible fallen riders thereon. A preferred range of tension is between about 10 $kg_f$/cm and 80 $kg_f$/cm, more preferably between about 20 $kg_f$/cm and 60 $kg_f$/cm, and most preferably between about 30 $kg_f$/cm and 40 $kg_f$/cm. If desired, one or more spring-biased elements may also be used, in order to provide tension overload regulation and to thereby protect the ride surface 150 from tearing in the event of a very large or unexpected impact force.

Figure 5A:
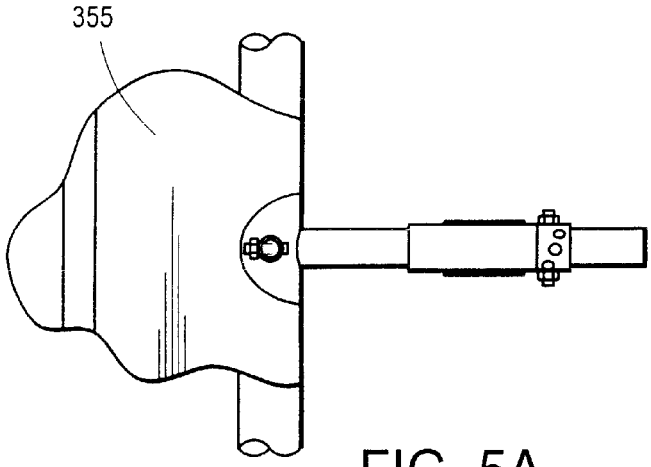
FIGS. 5A–C are detail assembly views of various securement and adjustment components for securing and tensioning a fabric-reinforced ride surface having feature and advantages in accordance with the present invention.
Figure 5B:
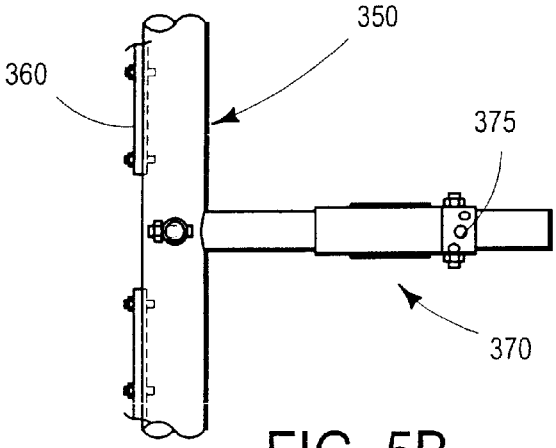
Figure 5C:
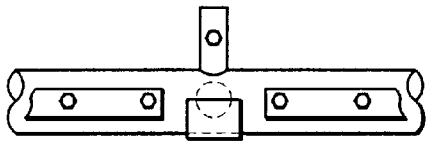
Figure 5D:
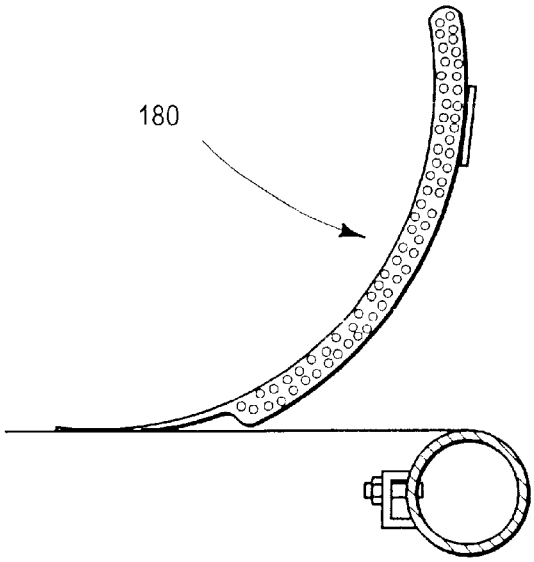
FIG. 5D is a detail view of an optional side padding member for a fabric-reinforced ride surface having feature and advantages in accordance with the present invention.

As illustrated in FIGS. 5A–D, preferably the fabric/membrane ride surface 150 is secured to the supporting frame 110 via one or more structural perimeter tubes or the like. For example, the fabric membrane material 150 may be wrapped around the perimeter tube 350 and then sewed or welded to itself to form a sling 355 which receives and holds the membrane material 150 to the perimeter tube 350 (see, e.g., FIGS. 5A–C). Alternatively and/or in addition, one or more mounting clamp members 360 may be provided for retaining a free end of the membrane material against the perimeter tube 350, as illustrated in FIG. 5A. If desired, both mounting systems may be implemented so as to have a redundant safety system in the event one securement fails. Optionally, a soft foam cushion 180 may be provided on each side of the ride surface 150 for added safety and protection of riders 10 (see, e.g., FIG. 5D).

Preferably, the supporting framework 110 is be shaped and/or the membrane ride surface 150 is selectively tensioned (evenly or unevenly) so as to impart a desired slope and/or curvature to the ride surface 150, as desired. The curvature may be a simple curve as illustrated in FIGS. 1 and 2 or it may include one or more compound curving, twisting, bowing, and/or bulging portions, as desired or as dictated by the particular ride application. For example, in the particular embodiment illustrated, the supporting framework 110 is shaped and configured so as to induce a simple upward accelerating curvature to the ride surface 150 for supporting an injected sheet flow of water thereon in a manner to facilitate flow boarding by riders thereon. The exact shape of the ride surface 150 is determined by the shape of the framework and the amount and direction of tension applied to the membrane by the supporting framework 110. Various compliant supports (not shown) and/or pneumatic or hydraulic pressure or vacuum forces may also be applied underneath the ride surface 150, if desired, to impart a desired shape or compliance characteristic thereto.

In the particular embodiment illustrated, the framework 110 and the amount and direction(s) of tension applied to the membrane ride surface 150 are substantially fixed or static, subject to only periodic adjustment or modification as may be necessary or desired. However, those skilled in the art will readily appreciate that the shape of the ride surface 150 may be adjusted dynamically, if desired, by suitably altering or controlling the shape of the supporting frame, applied tension, and/or by adjusting selected pressure or vacuum forces applied underneath the ride surface 150. For example, dynamically inflatable bladders, adjustable foam supports/rollers and/or other auxiliary support structures (not shown) may be implemented in the illustrated embodiment to provide a dynamically changing ride surface, if desired. These may be controlled hydraulically, pneumatically, mechanically, electrically or otherwise as well-know to those skilled in the art. Such a dynamic ride surface may be advantageous, for example, for competitions wherein different wave shapes and/or wave riding difficulty levels are desired. A dynamic ride surface could also be highly advantageous in providing a challenging wave riding experience providing progressively steeper, random and/or unpredictable changes in the shape of the ride surface during operation.

Of course, the invention disclosed and described herein is not limited to use with simulated surfing wave ride attractions as illustrated and described above. Rather, those skilled in the art will readily appreciate that the ride surface 150 may, alternatively, be incorporated into or otherwise used in connection with a wide variety of other sliding-type water and/or non-water ride attractions, such as flumes, slides, bowls, half-pipes, parabolic/oscillating slides and/or the like. Those skilled in the art will also recognize that a number of obvious modifications and improvements may be made to the invention without departing from the essential spirit and scope of the invention as disclosed herein.

Thus, although the invention has been disclosed in the context of certain preferred embodiments and examples, it will be understood that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A ride attraction comprising:

an inclined ride surface adapted to safely support one or more ride participants and/or ride vehicles sliding thereon;

the inclined ride surface comprising a substantially continuous sheet of membrane material supported along at least two edges thereof by a supporting framework;

the membrane material having a coating thereon adapted to provide a substantially smooth and generally lubricous sliding surface;

the membrane material being tensioned so as to provide a resilient, impact-safe support surface for ride participants and/or ride vehicles sliding thereon; and one or more nozzles for injecting a sheet flow of water upward upon the inclined ride surface comprising the tensioned membrane material.

2. The ride attraction of claim 1 wherein the ride surface comprises a polyester membrane material coated on at least one side with a fluorinated polymer material.

3. The ride attraction of claim 2 wherein the fluorinated polymer material comprises a layer of substantially pure PVDF.

4. The ride attraction of claim 1 wherein the membrane material comprises fibers or yarns of one or more of the following: carbon fiber, Kevlar®, rayon, nylon, polyester, PVC, and/or PVDF.

5. The ride attraction of claim 1 wherein the membrane material comprises a coating of one more of the following: rubber, polyurethane, latex, Teflon, fluorinated polymers, and/or PVDF.

6. The ride attraction of claim 1 wherein the membrane material tensioned substantially equally in weft and warp while a polymer coating approximately 200–300 $\mu$m thick is applied to the top and bottom surfaces thereof.

7. The ride attraction of claim 6 wherein at least one side of the membrane material is coated with an additional layer of fluorinated polymer material approximately 10–50 $\mu$m thick.

8. The ride attraction of claim 7 wherein the membrane material has an overall thickness of between about 0.5 and 2.0 mm and a weight less than about 5.0 kg/m$^2$.

9. The ride attraction of claim 1 wherein the membrane material is selected to have a tensile strength greater than about 20 kg$_f$/cm as determined by NF EN ISO 1421 FTMS 191A (Method 5102).

10. The ride attraction of claim 1 wherein the membrane material is selected to have a tensile strength greater than about 50 kg$_f$/cm as determined by NF EN ISO 1421 FTMS 191A (Method 5102).

11. The ride attraction of claim 1 wherein the membrane material is selected to have a tensile strength greater than about 90 kg$_f$/cm as determined by NF EN ISO 1421 FTMS 191A (Method 5102).

12. The ride attraction of claim 1 wherein the membrane material is selected to have a tear strength greater than about 50 kg$_f$ as determined by DIN 53.363 ASTM D 5733–95 (Trapezoid Method).

13. The ride attraction of claim 1 wherein the membrane material is selected to have a tear strength greater than about 75 kg$_f$ as determined by DIN 53.363 ASTM D 5733–95 (Trapezoid Method).

14. The ride attraction of claim 1 wherein the membrane material is selected to have a tear strength greater than about 90 kg$_f$ as determined by DIN 53.363 ASTM D 5733-95 (Trapezoid Method).

15. The ride attraction of claim 1 wherein the membrane material is tensioned between about 10 kg$_f$/cm and 80 kg$_f$/cm.

16. The ride attraction of claim 1 wherein the membrane material is tensioned between about 20 kg$_f$/cm and 60 kg$_f$/cm.

17. The ride attraction of claim 1 wherein the membrane material is tensioned between about 30 kg$_f$/cm and 40 kg$_f$/cm.

18. The ride attraction of claim 1 further comprising means for dynamically adjusting the tension applied to the membrane material.

19. The ride attraction of claim 1 further comprising a hydraulic or pneumatic adjustment device for dynamically adjusting the tension applied to the membrane material.

20. The ride attraction of claim 1 further comprising one or more auxiliary support structures for providing additional support to the ride surface.

21. A ride surface for ride attractions, the ride surface comprising a fabric-reinforced material supported by a structural framework and tensioned to at least 10 kg$_f$/cm, the fabric material being coated with a friction-reducing material adapted to facilitate sliding thereon by ride patrons.

22. The ride surface of claim 21 wherein the fabric-reinforced material comprises a polyester fabric material coated on at least one side with a fluorinated polymer material.

23. The ride surface of claim 22 wherein the fluorinated polymer material comprises a layer of substantially pure PVDF.

24. The ride surface of claim 21 wherein the fabric-reinforced ride material comprises fibers or yarns of one or more of the following: carbon fiber, Kevlar®, rayon, nylon, polyester, PVC, and/or PVDF.

25. The ride surface of claim 21 wherein the fabric-reinforced material comprises a coating of one more of the following: rubber, polyurethane, latex, Teflon, fluorinated polymers, and/or PVDF.

26. The ride surface of claim 21 wherein the fabric-reinforced material is tensioned substantially equally in weft and warp while a polymer coating approximately 200–300 $\mu$m thick is applied to the top and bottom surfaces thereof.

27. The ride surface of claim 26 wherein at least one side of the fabric-reinforced material is coated with an additional layer of fluorinated polymer material approximately 10–50 $\mu$m thick.

28. The ride surface of claim 21 wherein the fabric-reinforced material is selected to have a tensile strength greater than about 50 kgf/cm as determined by NF EN ISO 1421 FTMS 191A (Method 5102).

29. The ride surface of claim 21 wherein the fabric-reinforced material is selected to have a tensile strength greater than about 90 kg$_f$/cm as determined by NF EN ISO 1421 FTMS 191A (Method 5102).

30. The ride surface of claim 21 wherein the fabric-reinforced material is selected to have a tear strength greater than about 50 kg$_f$ as determined by DIN 53.363 ASTM D 5733-95 (Trapezoid Method).

31. The ride surface of claim 21 wherein the fabric-reinforced material is selected to have a tear strength greater than about 75 kg$_f$ as determined by DIN 53.363 ASTM D 5733-95 (Trapezoid Method).

32. The ride surface of claim 21 wherein the fabric-reinforced material is selected to have a tear strength greater than about 90 kg$_f$ as determined by DIN 53.363 ASTM D 5733-95 (Trapezoid Method).

33. The ride surface of claim 21 wherein the fabric-reinforced material is tensioned between about 10 kg$_f$/cm and 80 kg$_f$/cm.

34. The ride surface of claim 21 wherein the fabric-reinforced material is tensioned between about 20 kg$_f$cm and 60 kg$_f$/cm.

35. The ride surface of claim 21 wherein the fabric-reinforced material is tensioned between about 30 kg$_f$/cm and 40 kg$_f$/cm.

36. The ride surface of claim 21 further comprising one or more nozzles for injecting a sheet flow of water upward upon the inclined ride surface comprising the fabric-reinforced material.

37. The ride surface of claim 21 further comprising means for dynamically adjusting the tension applied to the fabric-reinforced material.

38. The ride surface of claim 21 further comprising a hydraulic or pneumatic adjustment device for dynamically adjusting the tension applied to the fabric-reinforced material.

39. The ride surface of claim 21 further comprising one or more auxiliary support structures for providing additional support to the ride surface.

40. A kit for assembling a ride attraction, comprising:

a fabric-reinforced ride surface sized and adapted to safely support one or more ride participants and/or ride vehicles thereon;

a supporting framework adapted to support and apply tension to the fabric ride surface; and tensioning means for adjusting the amount of tension applied by the framework to the ride surface.

41. The kit of claim 40 wherein the fabric-reinforced ride surface comprises a polyester fabric material coated on at least one side with a fluorinated polymer material.

42. The kit of claim 41 wherein the fluorinated polymer material comprises a layer of substantially pure PVDF.

43. The kit of claim 40 wherein the fabric-reinforced ride surface comprises fibers or yarns of one or more of the following: carbon fiber, Kevlar®, rayon, nylon, polyester, PVC, and/or PVDF.

44. The kit of claim 40 wherein the fabric-reinforced ride surface comprises a coating of one more of the following: rubber, polyurethane, latex, Teflon, fluorinated polymers, and/or PVDF.

45. The kit of claim 40 wherein the fabric-reinforced ride surface is tensioned substantially equally in weft and warp while a polymer coating approximately 200–300 $\mu$m thick is applied to the top and bottom surfaces thereof.

46. The kit of claim 45 wherein at least one side of the fabric-reinforced material is coated with an additional layer of fluorinated polymer material approximately 10–50 $\mu$m thick.

47. The kit of claim 46 wherein the fabric-reinforced ride surface has an overall thickness of between about 0.5 and 2.0 mm and a weight less than about 5.0 kg/m$^2$.

48. The kit of claim 40 wherein the fabric-reinforced ride surface is selected to have a tensile strength greater than about 20 kg$_f$/cm as determined by NF EN ISO 1421 FTMS 191A (Method 5102).

49. The kit of claim 40 wherein the fabric-reinforced ride surface is selected to have a tensile strength greater than about 50 kg$_f$/cm as determined by NF EN ISO 1421 FTMS 191A (Method 5102).

50. The kit of claim 40 wherein the fabric-reinforced ride surface is selected to have a tensile strength greater than about 90 kg$_f$/cm as determined by NF EN ISO 1421 FTMS 191A (Method 5102).

51. The kit of claim 40 wherein the fabric-reinforced ride surface is selected to have a tear strength greater than about 50 kg$_f$ as determined by DIN 53.363 ASTM D 5733-95 (Trapezoid Method).

52. The kit of claim 40 wherein the fabric-reinforced ride surface is selected to have a tear strength greater than about 75 kg$_f$ as determined by DIN 53.363 ASTM D 5733-95 (Trapezoid Method).

53. The kit of claim 40 wherein the fabric-reinforced ride surface is selected to have a tear strength greater than about 90 kg$_f$ as determined by DIN 53.363 ASTM D 573-95 (Trapezoid Method).

54. The kit of claim 40 wherein the fabric-reinforced ride surface is tensioned between about 10 kg$_f$/cm and 80 kg$_f$/cm.

55. The kit of claim 40 wherein the fabric-reinforced ride surface is tensioned between about 20 kg$_f$/cm and 60 kg$_f$/cm.

56. The kit of claim 40 wherein the fabric-reinforced ride surface is tensioned between about 30 kg$_f$/cm and 40 kg$_f$/cm.

57. The kit of claim 40 further comprising one or more nozzles for injecting a sheet flow of water upward upon the inclined ride surface comprising the fabric-reinforced material.

58. The kit of claim 40 wherein the tensioning means comprises means for dynamically adjusting the tension applied to the fabric-reinforced material.

59. The kit of claim 40 wherein the tensioning means comprises a hydraulic or pneumatic jack for dynamically adjusting the tension applied to the fabric-reinforced material.

60. The kit of claim 40 further comprising one or more auxiliary support structures for providing additional support to the fabric-reinforced ride surface.

61. A ride attraction comprising:

an inclined ride surface adapted to safely support one or more ride participants and/or ride vehicles sliding thereon;

the inclined ride surface comprising a sheet of membrane material supported along at least two edges thereof by a supporting framework;

the membrane material having a coating thereon adapted to provide a substantially smooth and generally lubricous sliding surface; and the membrane material being tensioned between about 10 kgf/cm and 80 kgf/cm so as to provide a resilient, impact-safe support surface for ride participants and/or ride vehicles sliding thereon.

62. The ride attraction of claim 61 wherein the ride surface comprises a polyester membrane material coated on at least one side with a fluorinated polymer material.

63. The ride attraction of claim 62 wherein the fluorinated polymer material comprises a layer of substantially pure PVDF.

64. The ride attraction of claim 61 wherein the membrane material comprises fibers or (yarns of one or more of the following: carbon fiber, Kevlar®, rayon, nylon, polyester, PVC, and/or PVDF.

65. The ride attraction of claim 61 wherein the membrane material comprises a coating of one more of the following: rubber, polyurethane, latex, Teflon, fluorinated polymers, and/or PVDF.

66. The ride attraction of claim 61 wherein the membrane material tensioned substantially equally in weft and warp while a polymer coating approximately 200–300 $\mu$m thick is applied to the top and bottom surfaces thereof.

67. The ride attraction of claim 61 wherein at least one side of the membrane material is coated with an additional layer of fluorinated polymer material approximately 10–50 $\mu$m thick.

68. The ride attraction of claim 61 wherein the membrane material is selected to have a tear strength greater than about 75 kg$_f$ as determined by DIN 53.363 ASTM D 5733-95 (Trapezoid Method).

69. The ride attraction of claim 61 further comprising one or more nozzles for injecting a sheet flow of water upward upon the inclined ride surface comprising the tensioned membrane material.

70. The ride attraction of claim 61 further comprising means for dynamically adjusting the tension applied to the membrane material.

71. The ride attraction of claim 61 further comprising a hydraulic or pneumatic adjustment device for dynamically adjusting the tension applied to the membrane material.

72. A ride attraction comprising:

an inclined ride surface adapted to safely support one or more ride participants and/or ride vehicles sliding thereon;

the inclined ride surface comprising a membrane material supported along at least two edges thereof by a supporting framework;

the membrane material having a coating thereon adapted to provide a substantially smooth sliding surface;

the membrane material being tensioned so as to provide a resilient, impact-safe support surface for ride participants and/or ride vehicles sliding thereon; and means for dynamically adjusting the tension applied to the membrane material.

73. The ride attraction of claim 72 wherein said adjusting means comprises a hydraulic or pneumatic adjustment device for dynamically adjusting the tension applied to the membrane material.

74. The ride attraction of claim 72 wherein the ride surface comprises a polyester membrane material coated on at least one side with a fluorinated polymer material.

75. The ride attraction of claim 72 wherein the fluorinated polymer material comprises a layer of substantially pure PVDF.

76. The ride attraction of claim 72 wherein the membrane material comprises fibers or yarns of one or more of the following: carbon fiber, Kevlar®, rayon, nylon, polyester, PVC, and/or PVDF.

77. The ride attraction of claim 72 wherein the membrane material comprises a coating of one more of the following: rubber, polyurethane, latex, Teflon, fluorinated polymers, and/or PVDF.

78. The ride attraction of claim 72 wherein the membrane material tensioned substantially equally in weft and warp while a polymer coating approximately 200–300 $\mu$m thick is applied to the top and bottom surfaces thereof.

79. The ride attraction of claim 72 wherein at least one side of the membrane material is coated with an additional layer of fluorinated polymer material approximately 10–50 $\mu$m thick.

80. The ride attraction of claim 72 wherein the membrane material is selected to have a tear strength greater than about 75 $kg_f$ as determined by DIN 53.363 ASTM D 5733-95 (Trapezoid Method).

81. The ride attraction of claim 72 further comprising one or more nozzles for injecting a sheet flow of water upward upon the inclined ride surface comprising the tensioned membrane material.

* * * * *